US005872356A

United States Patent [19]

Fischer et al.

[11] Patent Number: 5,872,356

[45] Date of Patent: Feb. 16, 1999

[54] SPATIALLY-RESOLVED ELECTRICAL DEFLECTION MASS SPECTROMETRY

[75] Inventors: Steven M. Fischer, Hayward; Curt A. Flory, Los Altos, both of Calif.; Kent D. Henry, Brooklyn, Wis.

[73] Assignee: Hewlett-Packard Company, Palo Alto, Calif.

[21] Appl. No.: 956,850

[22] Filed: Oct. 23, 1997

[51] Int. Cl.[6] ..... H01J 49/48

[52] U.S. Cl. ..... 250/281; 250/282; 250/294; 250/296; 250/396 R

[58] Field of Search ..... 250/281, 282, 250/294, 296, 396 R, 287, 295, 305

[56] References Cited

U.S. PATENT DOCUMENTS

| | | | |
|---|---|---|---|
| 2,642,535 | 6/1953 | Schroeder | 250/41.9 |
| 2,774,882 | 12/1956 | Wells | 250/41.9 |
| 3,769,513 | 10/1973 | Delany | 250/294 |
| 3,953,732 | 4/1976 | Oron et al. | 250/287 |
| 4,458,149 | 7/1984 | Muga | 250/287 |
| 4,472,631 | 9/1984 | Enke et al. | 250/281 |
| 4,831,254 | 5/1989 | Jenkins | 250/287 |
| 5,061,850 | 10/1991 | Kelly et al. | 250/306 |
| 5,091,732 | 2/1992 | Mileski et al. | 343/797 |
| 5,168,158 | 12/1992 | McComas et al. | 250/287 |
| 5,194,732 | 3/1993 | Bateman | 250/294 |
| 5,198,666 | 3/1993 | Bateman | 250/294 |
| 5,347,126 | 9/1994 | Krauss et al. | 250/309 |
| 5,420,423 | 5/1995 | Linden | 250/281 |
| 5,420,424 | 5/1995 | Carnahan et al. | 250/287 |
| 5,619,034 | 4/1997 | Reed et al. | 250/287 |
| 5,650,618 | 7/1997 | Tuszewski | 250/296 |

FOREIGN PATENT DOCUMENTS

4308299A1 9/1994 Germany .

OTHER PUBLICATIONS

Generation; of t–2 voltage pulses for ion analysers; R. M. Clement and H. T. Miles pp. 377–381, 1983.

Time–of–Flight Mass Spectrometer with Improved Resolution; W. C. Wiley and I. H. McLaren; Review Of Scientific Instruments –vol. 26, No. 12, Dec., 1955; pp. 1150–1157.

Analytic expression for non–linear ion extraction fields which yield ideal spatial focusing in time–of–flight mass spectrometry; Curt A. Flory, Robert C. Taber, George E. Yefchak; Hewlett Packard Laboratories, 3500 Deer Creek Rd., Palo Alto, CA 94304, USA; International Journal of Mass Spectrometry and Ion Processes 152 (1996) 169–176.

Analytic expression for the ideal one–dimensional mirror potential yielding perfect energy focusing in TOF mass spectrometry; Curt A. Flory, Robert C. Taber, George E. Yefchak, Hewlett–Packard Laboratories, 3500 Deer Creek Road, Palo Alto, CA 94304, USA; International Journal of Mass Spectrometry and Ion Processes 152 (1996) 177–184.

Mass Spectrometry Principles and Applications; Edmond De Hoffmann, Jean Charette, Vincent Stroobant, Universite catholique de Louvain, Belgium. No date and page no.

Mass Spectrometry –Applications in Science and Engineering; Frederick A. White, George M. Wood; pp. 138–144. No date.

43rd ASMS Conference on Mass Spectrometry and Allied Topics, 1995 –May 21–26, 1995 (Atlanta, GA); A New 2–D/3–D–TOF MS, H. Bernhard Linden and Michael Bamberg.

*Primary Examiner*—Kiet T. Nguyen

[57] ABSTRACT

A mass spectrometer is disclosed which yields fast, full-scan spectra over a wide mass-to-charge ratio range. The instrument contains an ion source which generates nearly monoenergetically-pulsed ion packets which spatially focus at a predetermined distance along the drift path of the ions, a mass filter/analyzer which linearly disperses or deflects the ions in the ion-packets by mass-to-charge ratio by applying a traverse, quadratically time-varying and increasing electric field over the entire length of the deflection region of the mass filter/analyzer, and a spatial mass detector. A method of analyzing the mass-to-charge ratio of ions is also disclosed.

5 Claims, 5 Drawing Sheets

SPATIALLY-RESOLVED ELECTRICAL DEFLECTION MASS SPECTROMETRY

FIELD OF THE INVENTION

This invention relates to the field of mass spectrometry, and more particularly to spatially-resolved electrical deflection mass spectrometry.

BACKGROUND OF THE INVENTION

There are five types of mass filters/analyzers used commercially today in mass spectrometry:

(1) sector (magnetic and electric types);

(2) quadrupole;

(3) ion cyclotron resonance;

(4) ion trap; and (5) time-of-flight.

Generally, time-of-flight mass filters offer fast analysis times in comparison with the other types of mass filters, however they are not intrinsically able to generate high resolution spectra. Generally, sector mass filters equipped with an array detector are able to generate high resolution spectra, however they are costly and large. Thus, there is a need to develop an instrument that offers the advantages of both of these types of instruments, including fast analysis time and high resolution spectra, without the attendant disadvantages, namely high cost and high space requirements.

U.S. Pat. No. 3,953,732 discloses a mass spectrometer and a method of mass spectrometry including the steps of:

(1) projecting a beam of particles which have a wide range of kinetic energy into an analyzing region;

(2) applying an electric field in the analyzing region in a direction transverse to the direction of the beam to deflect the particles in the beam independently of their initial kinetic energy as they enter the analyzing region along paths of length which are dependent upon the mass and charge of the particles; and (3) collecting the deflected particles at points spaced along the analyzing region from the entry of the beam in the analyzing region.

The method applies a time-dependent electric field which varies monotonically as an inverse function of time for the projection period to the particles which have a wide range of kinetic energy.

U.S. Pat. No. 5,420,423 discloses a mass spectrometer containing an ion source and a channel plate detector connected via a flight tube. Dispersion electrodes are positioned between the ion source and the detector. Shielding electrodes are placed closely to the dispersion electrodes to act as aperture lenses and shields of the electric field. As ion packets travel from the ion source toward the detector passing through the shielding electrodes and the gap between the dispersion electrodes, a dynamically-varying electric field is applied to the ion packets to deflect the ions according to their mass-to-charge ratio.

SUMMARY OF THE INVENTION

The mass spectrometer of the invention contains the following components:

(1) an ion source which generates nearly monoenergetically-pulsed ion packets which spatially focus at a predetermined distance along the drift path of the ions in the mass filter/analyzer;

(2) a mass filter/analyzer containing:

(a) a deflection region for the pulsed ion packets exiting from the ion source to drift; and ((b) a set of parallel plates located parallel to the drift path of the pulsed ion packets which applies a transverse, quadratically time-varying and increasing electrical field by applying a potential between the plates to the pulsed ion packets to linearly disperse or deflect the ions of the pulsed ion packet by mass-to-charge ratio as they drift within the deflection region, wherein the potential is defined as $$V(t)=a(t-T_{on})^2-b$$

where a=constant which determines spacing between ion mass peaks in the mass spectrum b=constant which determines range of ion masses which will be deflected onto the spatial mass detector for a given geometry t=time $T_{on}$=time-dependent electric field turn-on time wherein the potential generating the electric field is applied over the entire length of the deflection region and wherein the electric field lies perpendicular to the drift path of the pulsed ion packets; and (3) a spatial mass detector located at the end of the deflection region of the mass analyzer/filter and orthogonal to the ion source.

The method of the invention provides a means to analyze the mass-to-charge ratio of ions. The first step involves generating nearly monoenergetically-pulsed ion packets which spatially focus at a predetermined distance along the dift path of the ions in the mass filter/analyzer. The second step involves introducing the pulsed ion packets into a mass filter/analyzer. As the ion packets containing ions of varying mass-to-charge ratios drift the length of the deflection region of the mass filter/analyzer, a quadratically time-varying and increasing electric field is applied between the set of parallel plates through which the ion packets are traversing. The potential which is applied across the plates to generate the electric field is applied over the entire length of the deflection region, causing the nearly monoenergetically-pulsed ion packet to linearly disperse or deflect by the mass-to-charge ratio of the component ions. The third step involves collecting and analyzing the ions dispersed or deflected by mass-to-charge ratio using a spatial mass detector.

DETAILED DESCRIPTION OF THE INVENTION

Figure 1:
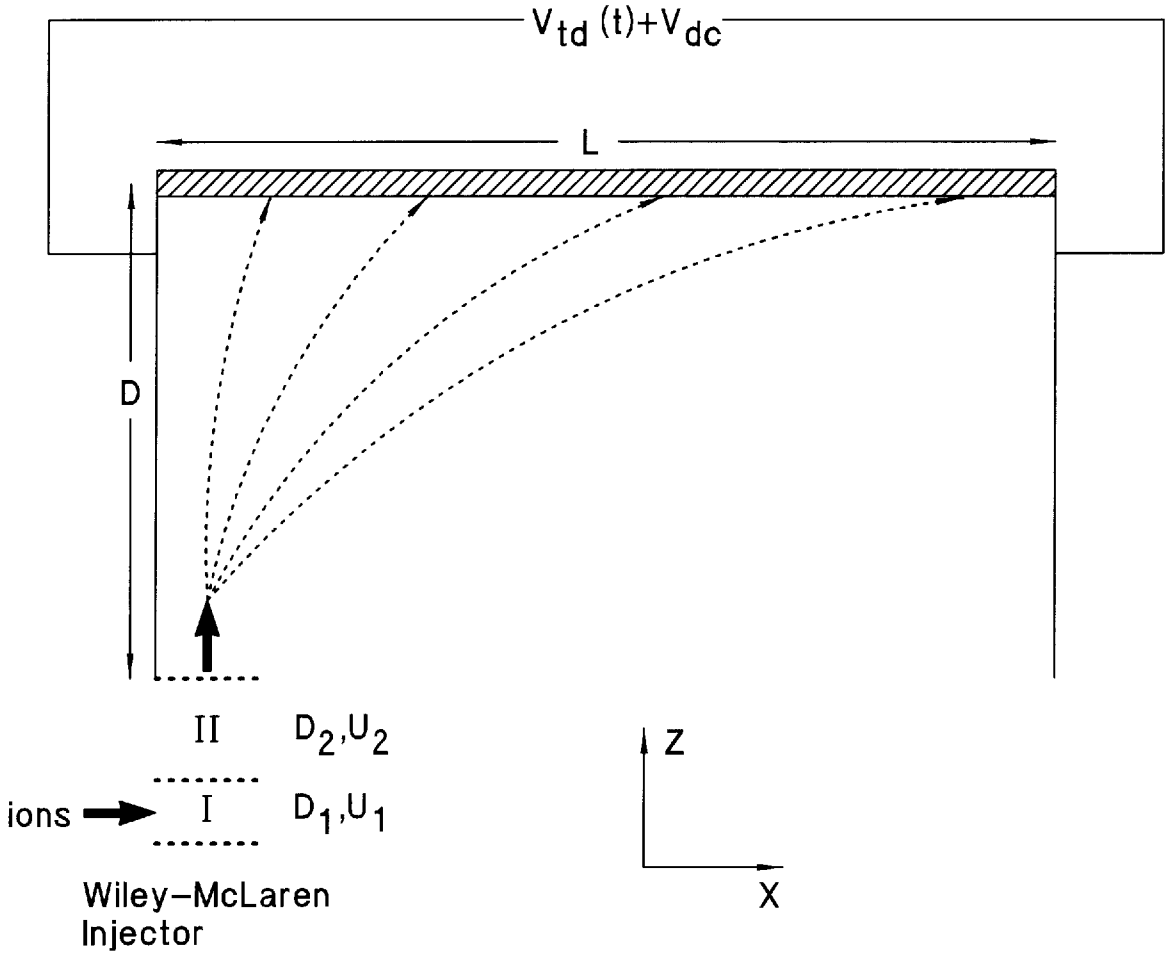
FIG. 1 is a schematic view of a mass spectrometer using a Wiley-McLaren two-stage ion injection system including the ion paths of several dispersed ions having different mass-to-charge ratios.

The mass spectrometer of the invention contains at least three components:

(1) an ion source;

(2) a mass filter/analyzer; and (3) a spatial mass detector.

The ion source and mass detector are components well-known in the art. The crux of the invention lies in the combination of two features:

(1) the use of an ion source which generates nearly monoenergetically-pulsed ion packets which spatially focus at a predetermined distance along the drift path of the ions in the mass filter/analyzer; and (2) the use of a mass filter/analyzer having special capabilities.

The mass spectrometer of the invention operates by first using an ion source to generate nearly monoenergetically-pulsed ion packets which spatially focus at a predetermined distance along the drift path of the ions in the mass filter/analyzer. The ions are injected into the deflection region of the mass filter/analyzer where they drift toward the spatial mass detector. As the ions drift in the z-direction, they are deflected in the lateral x-direction by an applied transverse, quadratically time-varying and increasing electric field with the total deflection at the plane of the spatial mass detector proportional to their individual mass-to-charge ratios. This deflection specification is adequate to determine the form of the required applied fields.

Ion Source

The ion source useful in the apparatus and method of the invention includes sources which generate nearly monoenergetically-pulsed ion packets which spatially focus at a predetermined distance along the drift path of the ions in the mass filter/analyzer. The ions in the ion packets must be at nearly the same energy and enter the mass filter/analyzer at the same time to enable the mass spectrometer to insure high mass-to-charge ratio resolution. As ions enter the deflection region of the mass filter/analyzer, they experience a transverse deflection proportional to their respective mass-to-charge ratio. All ions of the same mass-to-charge ratio will arrive at the same position on the detector if they enter the deflection region at the same time and have the same energy. However, if the ion pulse has a length in the propagation direction, then the ions enter the deflection region at different times. As a result, the ions at the tail end of the pulse will experience an electric field larger than the earlier ions, and, as a result, will undergo greater net transverse deflections. This effect causes a smearing of the mass-to-charge peaks and may cause the peaks to completely wash out. Therefore, an ion source is needed that generates ions where the later ions move faster than the earlier ions, such that the decrease in deflection distance due to decreased drift time exactly compensates for the stronger deflection fields. The mass-to-charge ratio peak resolution then may be restored.

Examples of such nearly monoenergetically-pulsed ion sources which spatially focus at a predetermined distance along the drift path of the ions in the mass filter/analyzer, which are well known to those in the art, include the Wiley-McLaren two-stage ion injection system as described in W. C. Wiley and I. H. McLaren, *Rev. Sci. Instrum.,* 26 (1955) 1150. This type of ion injection system is commonly used in time-of-flight mass spectrometry to enhance instrument resolution. The system contains two regions (hereinafter referred to as "extraction region I" and "extraction region II") as shown schematically in FIG. 1. The ions enter extraction region I, where a voltage is pulsed to eject them in the direction of the deflection region of the mass filter/analyzer. Ions closer to the interface between extraction regions I and II fall through a smaller potential drop than those farther from the interface. As a result, the ions that leave the extraction region I at a later time are moving with a greater velocity. This distribution of ions enters extraction region II, where it passes through a fixed potential drop, which has been chosen to cause the ions to spatially focus at a predetermined distance down the ion beam trajectory. The ion beam is characterized by the later ions having a higher velocity than the earlier ions.

Mass Filter/Analyzer

The mass filter/analyzer useful in the apparatus and method of the invention contains:

(1) a deflection region for the pulsed ion packets exiting from the ion source to drift;

and (2) a set of parallel plates located parallel to the drift path of the pulsed ion packets which apply a transverse, quadratically time-varying and increasing electrical field by applying a potential between the plates to the pulsed ion packets to linearly disperse or deflect the ions of the pulsed ion packet by mass-to-charge ratio as they drift within the deflection region, wherein the potential is defined as $$V(t)=a(t-T_{on})^2-b$$

where a=constant which determines the spacing between the mass peaks in the spectrum;

b=constant which determines which range of ion masses will be deflected onto the spatial mass detector for a given geometry;

t=time $T_{on}$=time-dependent electric field turn-on time wherein the potential generating the electric field is applied over the entire length of the deflection region of the mass filter/analyzer and wherein the electric field lies perpendicular to the drift path of the pulsed ion packets.

The mass filter/analyzer of the mass spectrometer of the invention applies a quadratically time-varying and increasing electric field to the pulsed ion packets to linearly disperse or deflect the ions. The quadratically time-varying electric field is generated by applying a potential between the set of parallel plates in the mass filter/analyzer by either:

(1) supplying voltage to one of the parallel plates (first electrode) with the voltage supplied to other parallel plate (second parallel electrode) held constant; or (2) asymmetrically supplying voltages to the parallel plates, e.g. by voltages of opposite signs to each of the two parallel plates.

For ions entering the deflection region with energy $U_o$, the z-directed velocity is given by $$v_z=\sqrt{\frac{2U_0}{m}} \tag{1}$$

where m=ion mass.

The time of flight of the ion to the spatial mass detector a distance D away is thus given as $$T_D=\left(\frac{m}{2U_0}\right)^{1/2}D \tag{2}$$

The equation of motion for the transverse displacement of an ion when a voltage V(t) is applied has the form $$m\frac{\partial^2 x}{\partial t^2}=\frac{qV(t)}{L} \tag{3}$$

where q=ion charge

L=distance between the parallel plates (electrodes) to which the potential is applied.

Integrating this equation twice from t=0 to t=$T_D$ yields $$m(x(T_D)-v(0)T_D-x(0))=\frac{q}{L}\int_0^{T_D}dt'\int_0^{t'}V(t'')dt'' \tag{4}$$

where $T_D$=time of flight to spatial mass detector x(0)=initial x-displacement (assumed zero)

v(0)=initial x-velocity (assumed zero)

It is required that the right side of equation (4) be proportional to $m^2$ to have $x(T_D)$ proportional to m. Because the right side of equation (4) is a function of $T_D$, and $T_D$ is proportional to $m^{1/2}$, it is required that the double integration yields an expression proportional to $T_D^4$. This determines the time-dependent applied potential to have the form $$V(t)=at^2 \tag{5}$$

where the parameter a determines the spatial dispersion with mass of the ion.

It is also possible to have an x-displacement offset to the mass spectrum by including a term in the applied potential which is independent of time $$V(t)=at^2-b \tag{6}$$

Substituting this form for the applied potential into the dynamical equation, doing the integrations and substituting the expression for $T_D$ yields $$x(T_D)=\frac{qaD^4}{48LU_0^2}\,m-\frac{qbD^2}{4LU_0} \tag{7}$$

In this equation, the linear spatial dispersion with mass is made manifest, and the dependence of the positional offset on the time-independent field represented by b is realized.

The specification of parameter a determines the spacing between the mass peaks in the spectrum, and the specification of parameter b determines which range of ion masses will be deflected onto the spatial mass detector for a given geometry. To characterize the behavior of the distribution of ions in the mass spectrometer of the invention, it is necessary to define a number of temporal quantities.

For example, in one embodiment of the invention where the ion source is a Wiley-McLaren two-stage ion injection system, the time origin is specified to be the instant when the extraction voltage $U_1$ is applied in extraction region I as shown in FIG. 1. A short time later, defined as the turn-on time, $T_{on}$, a quadratically time-varying and increasing electric field is applied across the deflection region in the mass filter/analyzer (which will be developed hereinafter)

$$V(t(=(a(t-T_{on})^2-b \tag{8}$$

Each ion has a different velocity depending upon its initial position in extraction region I and, thus, arrives at the entrance to the deflection region of the mass analyzer/filter at a different time. The difference between the arrival time of the ion and the turn-on time of the deflection fields $T_{on}$,, is defined as the lag-time, $T_{lag}$, of the individual ion. The different velocities of the various ions also means that each ion will have a different drift-time, $T_D$, through the transverse deflection region of the mass filter/analyzer. Thus, the expression for the transverse deflection, $x(T_D)$, must be generalized to include the additional dependence on the lag-time, $T_{lag}$, of the ion.

To determine the x-displacement of an ion on the spatial mass detector, including the dependence upon the lag time, the equation of motion for the transverse deflection $$m\frac{\partial^2 x}{\partial t^2}=\frac{qV(t)}{L} \tag{3}$$

must be integrated twice, from the time the ion enters the deflection region of the mass analyzer/filter until it strikes the surface of the spatial mass detector $$x(T_D,T_{lag})=\frac{q}{mL}\int_0^{T_D}dt'\int_0^{t'}[c(t''+T_{lag})^2-b]dt'' \tag{9}$$

This equation can be immediately integrated to yield the general expression for the transverse deflection of an ion passing through the mass spectrometer of the invention when the flight time of the ion through the deflection region is $T_D$ and the ion enters the deflection region at a time $T_{lag}$ after the quadratically time-varying and increasing electric field is applied $$x(T_D,T_{lag})=\frac{q}{mL}\left[\frac{c}{12}(T_D^4+4T_{lag}T_D^3+6T_{lag}^2T_D^2)-\frac{b}{2}T_D^2\right]+x(0) \tag{10}$$

Before explicitly calculating what the potential parameters are in terms of the geometrical factors and the specified mass range, it is necessary to choose the time-dependent field turn-on time, $T_{on}$. It is reasonable to have the electric field turn on when the first ions are entering the deflection region of the mass analyzer/filter. This occurs when the lightest ions in the desired mass spectrum which originate at the interface between extraction regions I and II of the Wiley-McLaren injector reach the entrance to the deflection region of the mass analyzer/filter. This is the flight time through the uniformly accelerated extraction region II of the Wiley-McLaren injector $$T_{on}=m_{min}^{1/2}D_2\sqrt{\frac{2}{U_2}} \tag{11}$$

The potential parameters c and b may be explicitly fixed by specifying the desired mass spectrum along the length of the spatial mass detector. In practice, this may be done by requiring that the lightest ion in the desired mass range which originates at the center of the extraction region I of the Wiley-McLaren injector arrives at the spatial mass detector at x=0, and the heaviest ion in the desired mass range which originates at the center of the extraction region I of the Wiley-McLaren injector arrives at the spatial mass detector at x=L. Selecting these two conditions fixes the potential parameters c and b.

The first condition takes the form $$x(\tilde{T}_D,\tilde{T}_{lag})=0 \tag{12}$$

where the drift time of the lightest ion in the spectrum which originates at the center of the extraction region I is given by $$\tilde{T}_D = \frac{Dm_{min}^{1/2}}{\sqrt{U_1 + 2U_2}} \tag{13}$$

and the lag time (the difference between the time through the injector and the turn-on time) for the lightest ions has the form $$\tilde{T}_{lag} = m_{min}^{1/2}\left[\frac{D_1}{\sqrt{U_1}} + \frac{D_2}{\sqrt{U_2}}\left(\sqrt{2 + U_1/U_2} - \sqrt{U_1/U_2}\right)\right] - T_{on} \tag{14}$$

The second condition takes the form $$x(\bar{T}_D, \bar{T}_{lag}) = L \tag{15}$$

where the drift time of the heaviest ion in the spectrum which originates at the center of the extraction region I is given by $$\bar{T}_D = \frac{Dm_{max}^{1/2}}{\sqrt{U_1 + 2U_2}} \tag{16}$$

and the lag time (the difference between the time through the injector and the turn-on time) for the heaviest ions has the form $$\bar{T}_{lag} = m_{max}^{1/2}\left[\frac{D_1}{\sqrt{U_1}} + \frac{D_2}{\sqrt{U_2}}\left(\sqrt{2 + U_1/U_2} - \sqrt{U_1/U_2}\right)\right] - T_{on}. \tag{17}$$

The two conditions can be used to solve for the potential parameters c and b in terms of the geometry of the mass spectrometer of the invention, the electric fields applied and the specified mass range. The explicit formulas for these parameters are $$c = \frac{12m_{max}L^2}{\bar{T}_D^2[(\bar{T}_D^2 + 4\bar{T}_{lag}\bar{T}_D + 6\bar{T}_{lag}^2) - (\tilde{T}_D^2 + 4\tilde{T}_{lag}\tilde{T}_D + 6\tilde{T}_{lag}^2)]} \tag{18}$$

and $$b = \frac{c}{6}\left(\tilde{T}_D^2 + 4\tilde{T}_{lag}\tilde{T}_D + 6\tilde{T}_{lag}^2\right). \tag{19}$$

Parameter c determines the spacing between the mass peaks in the spectrum, and the specification of parameter b determnines which range of ion masses will be deflected onto the spatial mass detector for a given geometry.

It is possible to estimate the transverse, time-varying and increasing electrical field which must be applied to the pulsed ion packets to linearly disperse or deflect the ions of the pulsed ion packet by mass-to-charge ratio as they drift within the deflection region, based on a practical configuration of the mass spectrometer and time scales. First, to determine the maximum potential required, the maximum length of time that the potential is applied must be estimated. This maximum length of time corresponds to the maximum flight time of any of the relevant ions, that is, the slowest ions which have the highest mass in the desired spectrum and may be represented as $$T_{max} = \bar{T}_D + \bar{T}_{lag} \tag{20}$$

This time is dominated by the drift time through the deflection region of the mass filter/analyzer because the drift distance is much greater than any relevant dimension of the Wiley-McLaren injector. Thus, $$T_{max} \sim \bar{T}_D \sim \frac{Dm_{max}^{1/2}}{\sqrt{2U_2}} \tag{21}$$

Therefore, the maximum time-dependent potential is approximated as $$[V(t)]_{max} \sim a(T_{max} - T_{on})^2 \sim cT_{max}^{\ 2} \tag{22}$$

Substituting in the previous expressions for $T_{max}$ and c, and using the approximation that the drift times are much greater than the lag times, the maximum time-dependent potential can be approximated as $$[V(t)]_{max} \sim 24\frac{m_{max}}{(m_{max} - m_{min})}\left(\frac{L}{D}\right)^2 U_2 \tag{23}$$

The corresponding applied temporally-constant potential can be determined by substituting in previous expressions and using the approximation that drift times are much greater than the lag times, yielding $$[V_{dc}]_{max} = \frac{[V(t)]_{max}}{6}\left(\frac{m_{min}}{m_{max}}\right) \tag{24}$$

Spatial Mass Detector

The spatial mass detector useful in the apparatus and method of the invention is any mass detector which collects ions which are separated, dispersed or deflected according to spatial or positional differences. The spatial mass detector is located at the end of the deflection region of the mass analyzer/filter and orthogonal to the ion source.

Suitable spatial mass detectors include an array detector or micro-channel plate detector, which is well known to those in the art. Typical array detectors contain a plate having drilled therein parallel cylindrical channels with channel diameters ranging from 4 to 25 $\mu$m and the center-to-center distances ranging from 6 to 32 $\mu$m. The plate input side is kept at a negative potential of about 1 kV relative to the output side. Each channel is coated with a semiconductor substance which produces electron multiplication and gives off secondary electrons. Curved channels prevent the deflection of positive ions towards the input side. Two plates may be connected herringbone-wise or three plates can be connected following a Z shape. At every channel exit, a metal anode gathers the stream of secondary electrons and the signals are transferred to a processor. Ions with different mass-to-charge ratios reach different spots and may be counted at the same time during the analyzer scan.

Another suitable spatial mass detector is disclosed in *Rev. Sci. Instru.* 63, 235 (1992).

Optional Components

The mass spectrometer of the invention may be constructed with additional electrodes located adjacent to the spatial mass detector to collect and terminate ions outside of the mass range of interest, both lower and higher than the range of interest.

These ions impact the additional electrodes enabling the apparatus to sense the need to scan lower and/or higher in the range of mass-to-charge ratio. This distinct termination feature enables the apparatus to achieve significant gains in duty cycle or ion current utilization as compared to conventional time-of-flight mass spectrometers, when analyzing ions from continuous ion generation sources, such as atmospheric pressure ionization sources coupled with liquid chromatography.

The mass spectrometer and method of the invention provide a number of advantages over conventional spectrometers, including:

(1) higher resolution spectra;
(2) lower cost;
(3) lower space requirements;
(4) fast analysis time; and
(5) detection of ions outside range of interest.

The unique features of the apparatus and method of the invention over conventional instruments and methods lie in the combination of the following:

(1) the electric field is applied to nearly monoenergetically-pulsed ion packets which spatially focus at a predetermined distance along the drift path of the pulsed ion packets in the mass filter/analyzer;
(2) the electric field is quadratically time-varying and increasing;
(3) the potential applied to generate the electric field is applied over the entire length of the deflection region in the mass filter/analyzer; and
(4) the electric field has been fully derived and characterized as the sole mass-to-charge ratio analyzer through the linear dispersion of ions in applications to mass spectrometry.

It should be understood that the above description is intended to illustrate and not limit the scope of the invention. Other aspects, advantages and modifications within the scope of the invention will be apparent to those skilled in the art to which the invention pertains.

The following examples are put forth so as to provide those of ordinary skill in the art with a complete disclosure and description of how to make and use the method and products of the invention, and are not intended to limit the scope of what the inventors regard as their invention.

EXAMPLES

The performance of the mass spectrometer of the invention was simulated by a computer program that calculates ion trajectories for a distribution of ions with a distribution of initial positions within the Wiley-McLaren extraction region I. It is assumed that the ions have no initial velocity in the x or z directions. The parameters used in the simulations of the Examples have the following values:

L=25.4 cm

D=50.0 cm $D_1$=0.1 cm $D_2$=0.4 cm $U_2$=200.0 volts $U_1$~8.0 volts (optimized for best resolution for specified mass range)

$S_x$=0.05 cm (ion source extent in x-direction)

Simulation I

For range of masses=200–250 amu $c=5.68\times10^{11}$ volts/sec$^2$ b=126 volts the maximum flight time of any ion in this spectrum is 40 μsec, implying that the maximum voltage attained by the quadratically time-varying and increasing electrical field V(t) is 928 volts. Maximum resolution is achieved with an empirically-determined extraction voltage of $U_1$=8.0 volts. It has been assumed that the ion beam has equal numbers of ions at each of the masses from 200 atomic mass units (amu) to 250 amu.

Figure 2:
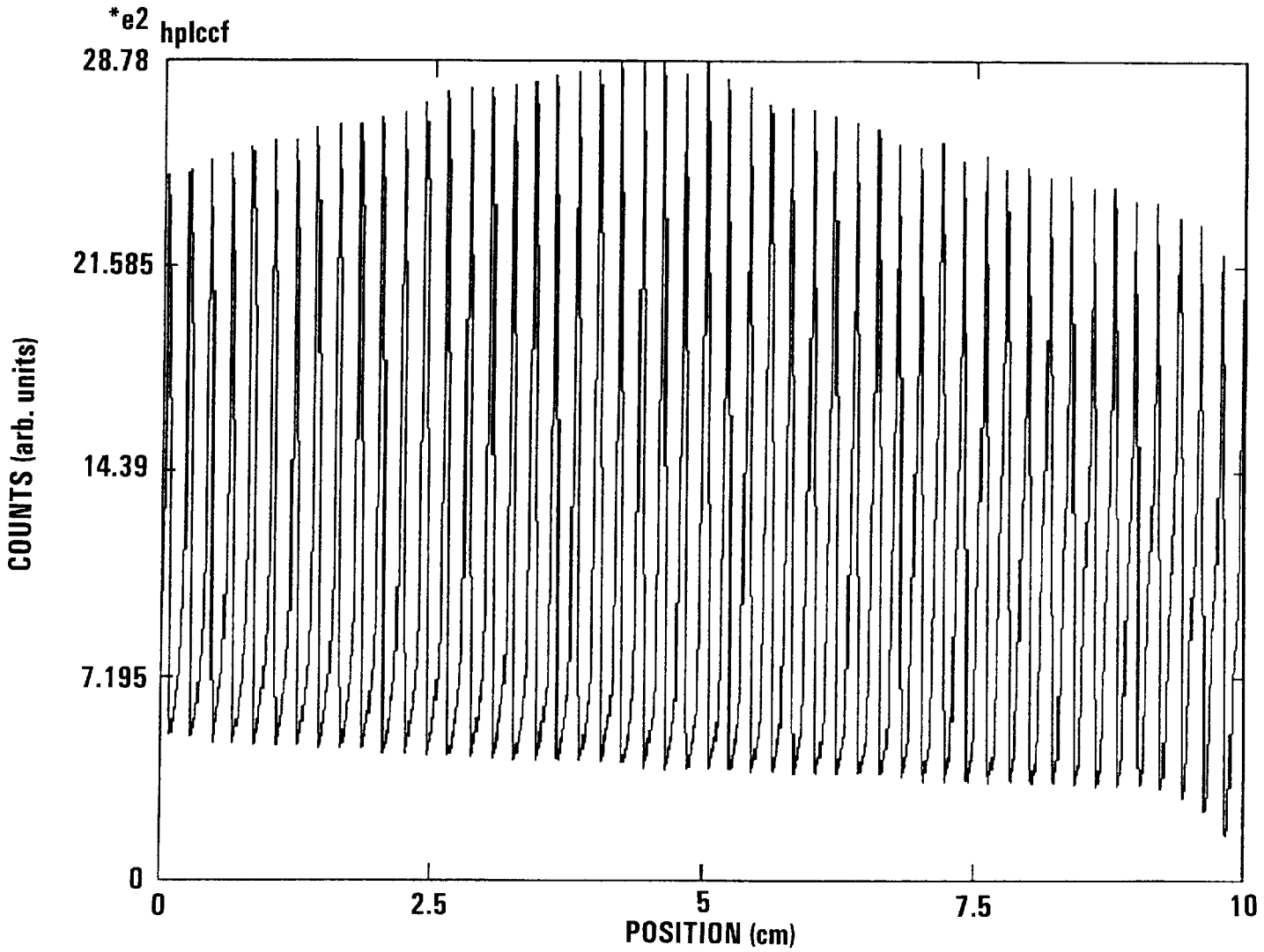
FIG. 2 is a plot of counts as a function of position for Simulation 1.

The spectrum of counts (arbitrary units) as a function of position (in centimeters) from simulation 1 is shown in FIG. 2. All peaks were clearly resolved and equally spaced between the specified limits at the ends of the spatial mass detector.

Figure 3:
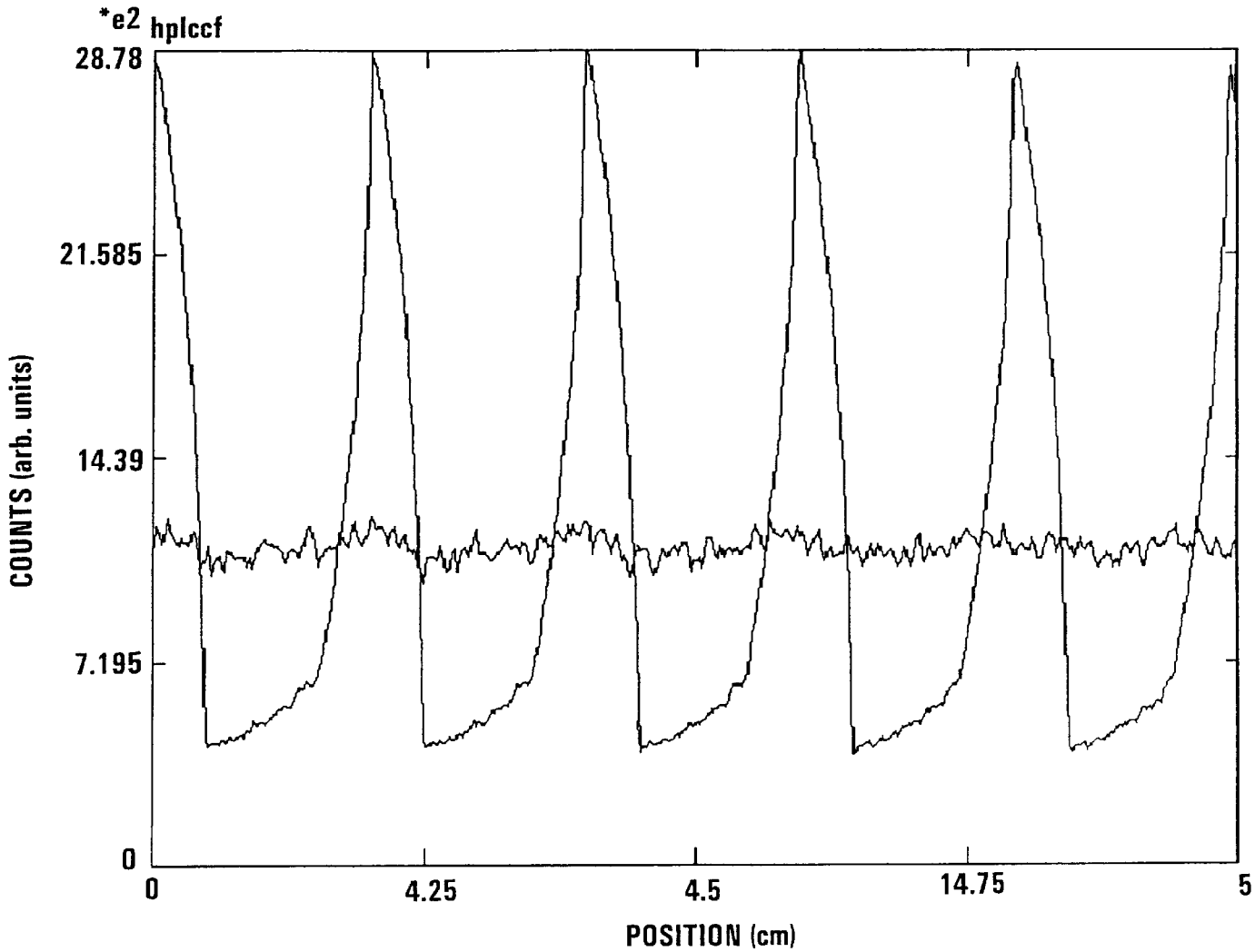
FIG. 3 is an expanded view of FIG. 2 in the spatial mass detector region from 4 cm to 5 cm with an overlay of the calculated signal when the extraction voltage is "detuned" to a value of $U_1$=2 volts.

FIG. 3 shows an expanded view of FIG. 2 in the spatial mass detector region from 4 cm to 5 cm with an overlay of the calculated signal when the extraction voltage is "detuned" to a value of U=2 volts. In the simulation, detuning the extraction voltage caused the mass peaks to become completely unresolved, giving a smooth distribution of ions at the plane of the spatial mass detector demonstrating the importance of a well-controlled ion source injection process.

Simulation 2

For range of masses=1000–1050 amu $c=5.68\times10^{11}$ volts/sec$^2$ b=633 volts the maximum flight time of any ion in this spectrum is 83 μsec, implying that the maximum voltage attained by the quadratically time-varying and increasing electrical field V(t) is 3.9 kV. The dc deflection voltage $V_{dc}$ has been further increased by a factor of 1.001 to permit the spectrum endpoints to lie exactly at the edges of the spatial mass detector. Maximum resolution is achieved with an empirically-determined extraction voltage of $U_1$=8.0 volts. It has been assumed that the ion beam has equal numbers of ions at each of the masses from 1000 amu to 1050 amu.

Figure 4:
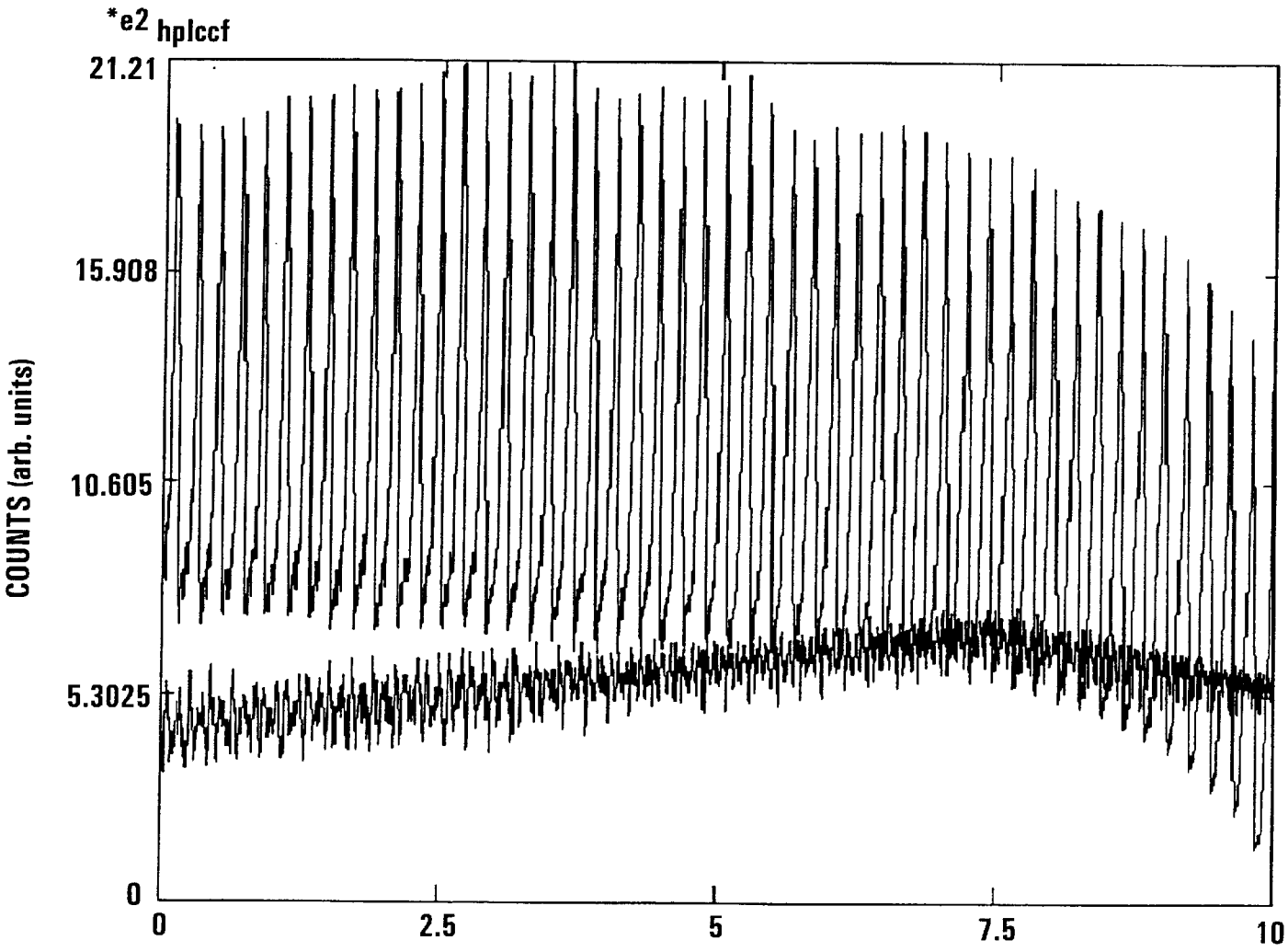
FIG. 4 is a plot of counts as a function of position for Simulation 2.

The spectrum of counts (arbitrary units) as a function of position (in centimeters) from simulation 2 is shown in FIG. 4. All peaks were clearly resolved and equally spaced between the specified limits at the ends of the spatial mass detector. FIG. 4 also contains an overlay of the calculated signal when the extraction voltage is "detuned" to a value of $U_1$=2 volts. In the simulation, detuning the extraction voltage caused the mass peaks to become completely unresolved, giving a smooth distribution of ions at the plane of the spatial mass detector demonstrating the importance of a well-controlled ion source injection process.

Simulation 3

For range of masses=2000–2050 amu $c=5.68\times10^{11}$ volts/sec$^2$ b=1267 volts the maximum flight time of any ion in this spectrum is 116 μsec, implying that the maximum voltage attained by the quadratically time-varying and increasing electrical field V(t) is 7.6 kV. The dc deflection voltage $V_{dc}$ has been further increased by a factor of 1.0013 to permit the spectrum endpoints to lie exactly at the edges of the spatial mass detector. Maximum resolution is achieved with an empirically-determined extraction voltage of $U_1$=8.0 volts. It has been assumed that the ion beam has equal numbers of ions at each of the masses from 2000 amu to 2050 amu.

Figure 5:
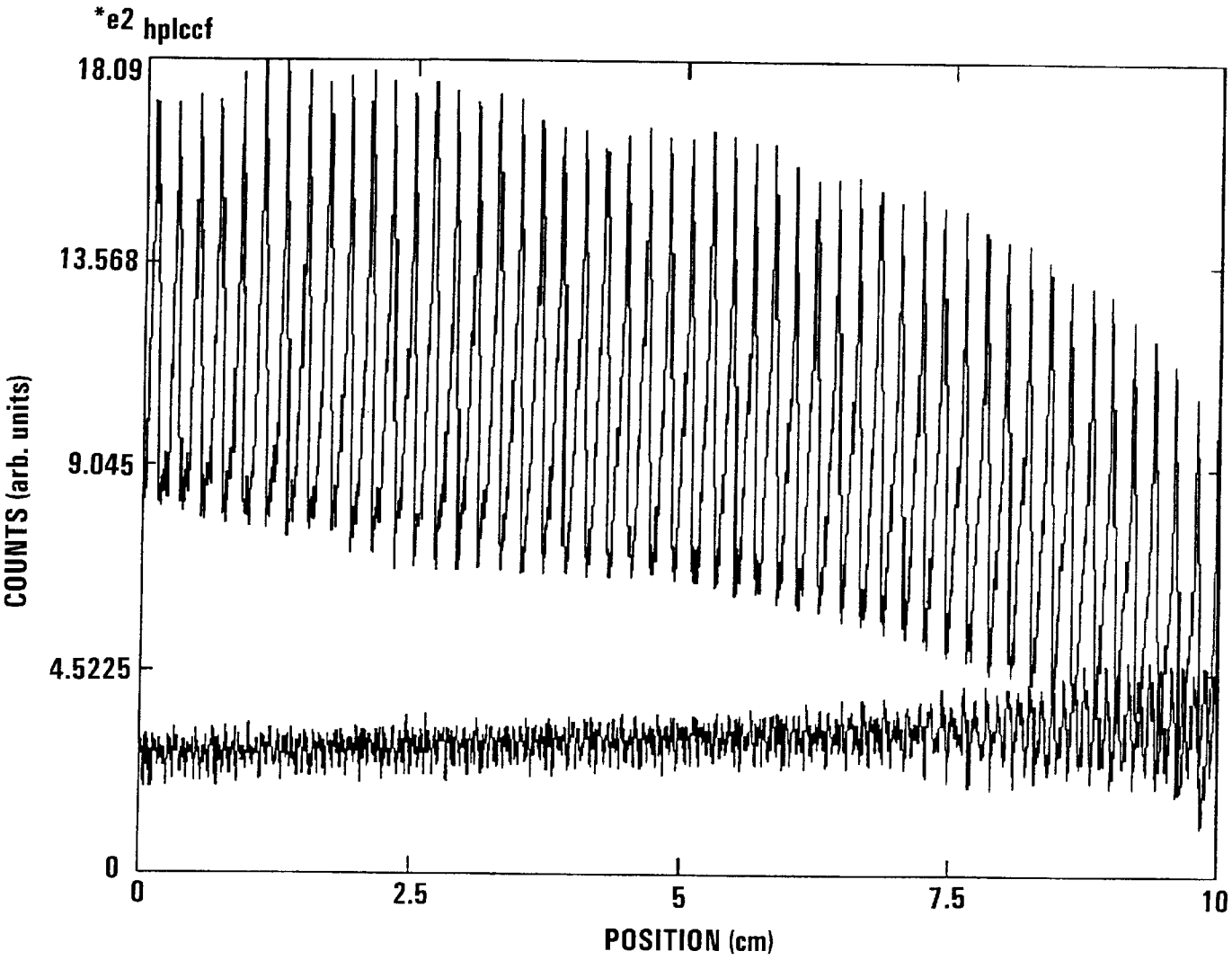
FIG. 5 is a plot of counts as a function of position for Simulation 3.

The spectrum of counts (arbitrary units) as a function of position (in centimeters) from simulation 3 is shown in FIG. 5. All peaks were clearly resolved and equally spaced between the specified limits at the ends of the spatial mass detector. FIG. 6 also contains an overlay of the calculated signal when the extraction voltage is "detuned" to a value of $U_1$=2 volts. In the simulation, detuning the extraction voltage caused the mass peaks to become completely unresolved, giving a smooth distribution of ions at the plane of the spatial mass detector demonstrating the importance of a well-controlled ion source injection process.

While the invention has been described and illustrated with reference to specific embodiments, those skilled in the art will recognize that modification and variations may be made without departing from the principles of the invention as described herein above and set forth in the following claims.

What is claimed is:

1. A mass spectrometer comprising an ion source, a mass filter/analyzer and a spatial mass detector for generating a mass spectrum, wherein:

a. said ion source generates nearly monoenergetically-pulsed ion packets which spatially focus at a predetermined distance along a drift path of said pulsed ion packets in said mass filter/analyzer;

b. said mass filter/analyzer comprising:

i. a deflection region for said ion packets to drift;

ii. a set of parallel plates located parallel to said drift path of said pulsed ion packets which apply a transverse, quadratically time-varying and increasing electrical field by applying a potential between said plates to the pulsed ion packets to linearly disperse said ion packets by mass-to-charge ratio as said ion packets drift within said deflection region, wherein said potential is defined as $$V(t)=c(t-T_{on})^2-b$$

where c=constant which determines spacing between ion mass peaks in said mass spectrum b=constant which determines range of ion masses which will be deflected onto said spatial mass detector for a given geometry t=time $T_{on}$=time-dependent electric field turn-on time wherein said potential generating said electric field is applied over the entire length of said deflection region and wherein said electric field lies perpendicular to said drift path of said pulsed ion packets;

and c. said spatial mass detector is located at the end of said deflection region and orthogonal to said ion source.

2. The mass spectrometer of claim 1, wherein said ion source is a Wiley-McLaren two-stage ion injection system.

3. The mass spectrometer of claim 1, wherein said spatial mass detector is an array detector.

4. The mass spectrometer of claim 1, further comprising at least one electrode adjacent to said spatial mass detector to collect ions of a mass-to-charge ratio outside the range of interest.

5. A method of analyzing the mass-to-charge ratio of ions, comprising the steps of:

(1) generating nearly monoenergetically-pulsed ion packets containing ions of at least one mass-to-charge ratio which spatially focus at a predetermined distance;

(2) filtering said ion packets to linearly disperse said ions by mass-to-charge ratio by:

i. providing a deflection region for said ion packets to drift;

ii. applying a traverse, quadratically time-varying and increasing electrical field to the pulsed ion packets as said ion packets drift within said region wherein said electric field is applied over the entire length of said deflection region; and (3) collecting and analyzing said ions.

* * * * *